US007221888B2

(12) United States Patent
Hymas et al.

(10) Patent No.: US 7,221,888 B2
(45) Date of Patent: May 22, 2007

(54) PRINTING DEVICE CARTRIDGE HAVING POSITION IN WHICH ROLLERS ARE SEPARATED FROM PHOTOCONDUCTOR

(75) Inventors: Scott K. Hymas, Meridian, ID (US); Patrick Dougherty, Boise, ID (US); Brent L. Meyer, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/113,541

(22) Filed: Apr. 24, 2005

(65) Prior Publication Data

US 2006/0239711 A1 Oct. 26, 2006

(51) Int. Cl.
*G03G 21/16* (2006.01)

(52) U.S. Cl. ..... 399/111; 399/113; 399/114; 399/262

(58) Field of Classification Search ..... 399/111–114, 399/116, 119, 262
See application file for complete search history.

(56) References Cited

U.S. PATENT DOCUMENTS

| | | | | |
|---|---|---|---|---|
| 5,153,640 | A * | 10/1992 | Okabe | 399/113 |
| 5,845,177 | A | 12/1998 | Choi | |
| 6,381,432 | B1 | 4/2002 | Hattori | |
| 6,445,896 | B1 | 9/2002 | Satoh | |
| 6,516,169 | B2 | 2/2003 | Niimi et al. | |
| 6,665,507 | B1 | 12/2003 | Hooper, III et al. | |
| 6,980,759 | B2 * | 12/2005 | Kanno et al. | 399/111 |
| 2003/0185587 | A1 * | 10/2003 | Kawai et al. | 399/111 |
| 2004/0005168 | A1 | 1/2004 | Back | |
| 2005/0025522 | A1 * | 2/2005 | Tsuzuki et al. | 399/111 |
| 2005/0053394 | A1 * | 3/2005 | Ishii et al. | 399/111 |

FOREIGN PATENT DOCUMENTS

| | | |
|---|---|---|
| EP | 0405514 | 1/1991 |
| EP | 1041456 | 10/2000 |
| JP | 07234552 | 1/1996 |
| JP | 09081012 A * | 3/1997 |
| JP | 2001042622 | 6/2001 |
| JP | 2001312196 | 4/2002 |

OTHER PUBLICATIONS

International Search Report for Application No. PCT/US2006/015188. Report issued Sep. 4, 2006.

* cited by examiner

*Primary Examiner*—David M. Gray
*Assistant Examiner*—Laura K Roth

(57) ABSTRACT

A cartridge for a printing device includes first and second portions coupled to one another and capable of moving relative to each other, one or more rollers situated at the first portion, a photoconductor situated at the second portion, and a lock mechanism. The rollers are in contact with the photoconductor in a first position of the first and the second portions. The lock mechanism maintains the first and the second portions in a second position in which the rollers are separated from the photoconductor.

25 Claims, 8 Drawing Sheets

PRINTING DEVICE CARTRIDGE HAVING POSITION IN WHICH ROLLERS ARE SEPARATED FROM PHOTOCONDUCTOR

BACKGROUND

Laser printers have become very popular, especially where fast printer output is desired. Other types of printers that operate on the same principle as laser printers, such as printers that utilize light-emitting diodes (LED's) instead of lasers, are also available and have become popular. A laser printer generally works as follows. An image transfer roller, which may also be referred to as a photoreceptor drum, a photoconductor drum, an organic photoconductor, an optical photoconductor, or a photoconductor, is pre-charged using a charge roller or corona wire. A laser then writes the desired image onto the photoconductor, electrostatically discharging the photoconductor according to the desired image. Meanwhile, a toner transfer roller, or developer roller, is coated with charged toner from a toner hopper, or toner cartridge sump.

Traditionally, laser printers maintained a small gap between the photoconductor and the developer roller and/or the charge roller. This is especially the case with black-and-white laser printers. However, more recently laser printers have had the photoconductor come into contact with the developer roller and/or the charge roller.

Photoconductors can be relatively hard, however. Therefore, if the relatively soft developer and/or charge rollers remain in contact with them constantly, especially during shipment of toner cartridges of which the photoconductors and these rollers are a part, these rollers can go out of round, developing flat spots. Such deformation of the rollers can result in image quality degradation. At best, the rollers regain their round shape over time, and image quality improves. At worst, though, the rollers retain their deformed shape, and image quality may not improve.

Furthermore, the photoconductors may develop what is referred to as rub memory if the developer and/or charge rollers remain in contact with them constantly. Rub memory is the build up of a charge onto the surface of a photoconductor, due to constant contact with the rollers. This build up of charge is exhibited in the images formed on media by repeating lines throughout the image. At best, the rub memory dissipates over time, and the repeating lines cease. At worst, however, the rub memory does not dissipate, and the repeating lines do not stop.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
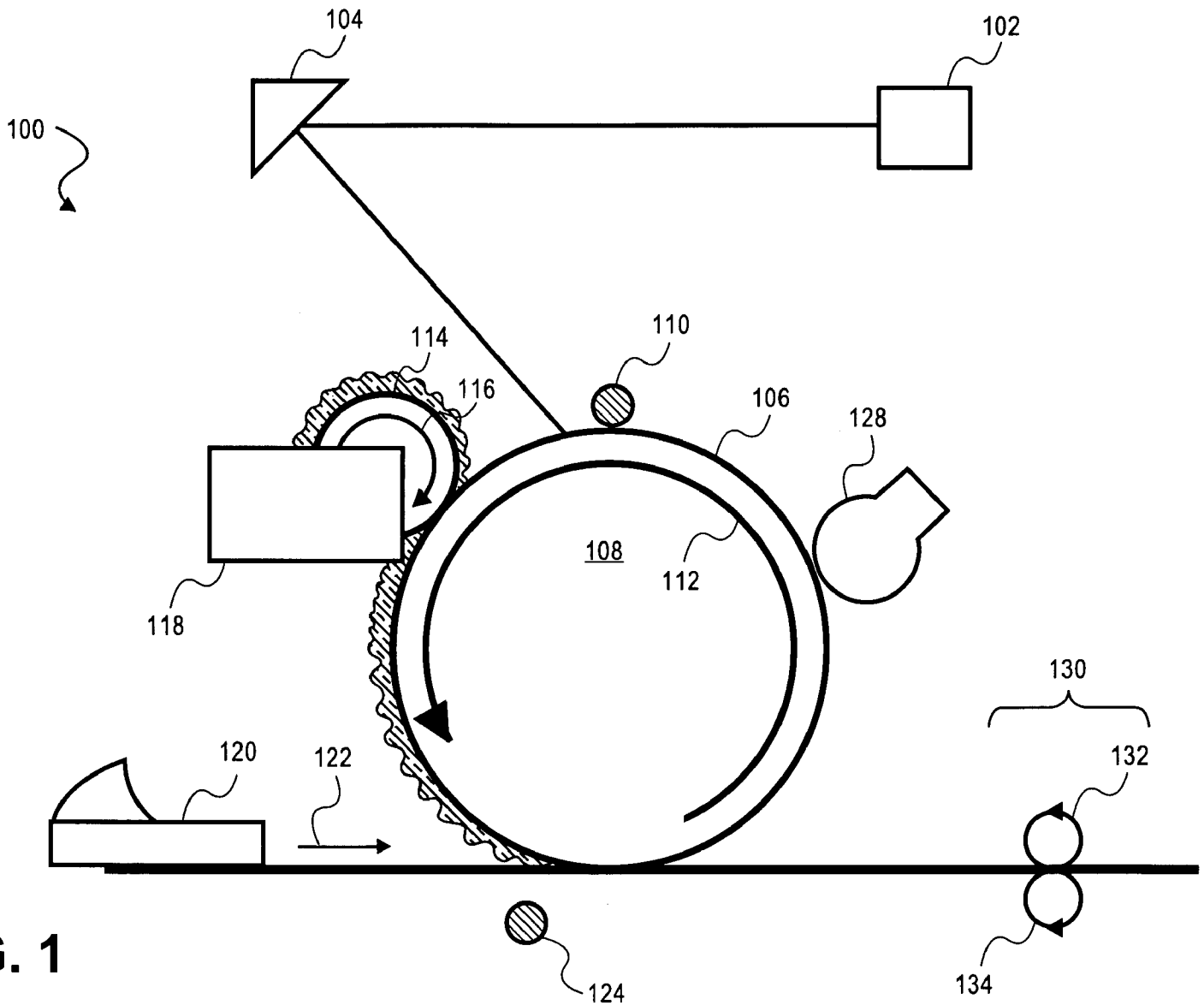
FIG. 1 is a diagram of the manner by which laser printing can be accomplished, according to an embodiment of the invention.

FIG. 1 shows an example laser-printing mechanism 100 by which laser printing can be accomplished, according to one embodiment of the invention. The laser-printing mechanism 100 may be a part of a laser printer or another type of laser-printing device. The photoconductor drum 108 is made from highly photoconductive material that is discharged by light photons. The photoconductor drum 108 may also be referred to as a photoreceptor drum, a photoconductor, an optical photoconductor, or an organic photoconductor. Initially, the drum 108 is given a total positive charge via a charge roller 110. The charge roller 110 is in contact with the drum 108 during image formation on the media 120 for precise alignment of the image to be formed on the media 120. At other times, during non-use, the charge roller 110 may be separated from the photoconductor drum 108, as will be described.

As the drum 108 revolves, the printing mechanism 100 shines a laser beam emanating from the laser beam light source 102, and reflected by the reflector 104, onto the surface 106 of the drum 108 to discharge certain points in accordance with an image. In this way, the laser draws, or scans, the image to be printed as a pattern of electrical charges, which can be referred to as an electrostatic image. The drum 108 rotates counter-clockwise, as indicated by the arrow 112. After the pattern has been set, the printing mechanism 100 coats the drum 108 with charged toner, which is a fine powder. The toner also has a positive charge, so the toner clings to the discharged areas of the drum 108, but not to the positively charged background.

The toner is dispensed by a developer roller 114 that rotates clockwise, as indicated by the arrow 116, against the drum 108, after having rotated through the toner hopper 118 to pick up toner. The developer roller 114 is also in contact with the drum 108 during image formation on the media 120 for precise alignment of the image to be formed on the media 120. At other times, during non-use, the developer roller 114 may be separated from the photoconductor drum 108, as will be described. With the powder pattern affixed, the drum 108 rolls over a sheet of media 120, which moves in the direction indicated by the arrow 122. Before the media 120 rolls under the drum 108, it is given a negative charge by the transfer roller 124. This charge is stronger than the charge of the electrostatic image, so the media 120 pulls the powder away from the drum 108. Since it is moving at the same speed as the drum 108, the media 120 picks up the image pattern exactly.

The printing mechanism 100 finally passes the media 120 through the fuser 130, which can be a pair of heated rollers 132 and 134 that move in opposite direction. As the media 120 passes through these rollers 132 and 134, the loose toner powder melts, fusing with the fibers in the media 120. The fuser 130 rolls the media 120 to an output tray, providing a printed page. After depositing the toner on the media 120, the drum 108 passes the discharge lamp. 128, which is a bright light. This exposes the entire photoreceptor surface of the drum 108, erasing its electrical image, so that the process is ready to be repeated.

At least some components of the laser-printing mechanism 100 of FIG. 1 may be encased within a removable toner cartridge that can be replaced when the toner supply of the cartridge has been depleted. For instance, the toner hopper 118 or a corresponding component thereto, the photoconductor drum 108, the developer roller 114, and the charge roller 110 may all be encased within a removable toner cartridge. As such, when the toner supply present in the toner hopper 118 or the corresponding component thereto has been depleted, the toner cartridge is replaced with a new, fresh toner cartridge to continue forming images on media.

Furthermore, the laser-printing mechanism 100 of FIG. 1 is a single color mechanism, in that the toner stored within the toner hopper 118 is a single color. For multiple-color printers, there can be more than one laser-printing mechanism within a given printer, which may share some components. As one example, there may be a black laser-printing mechanism, a cyan laser-printing mechanism, a magenta laser-printing mechanism, and a yellow laser-printing mechanism to achieve full-color printing.

Figure 2A:
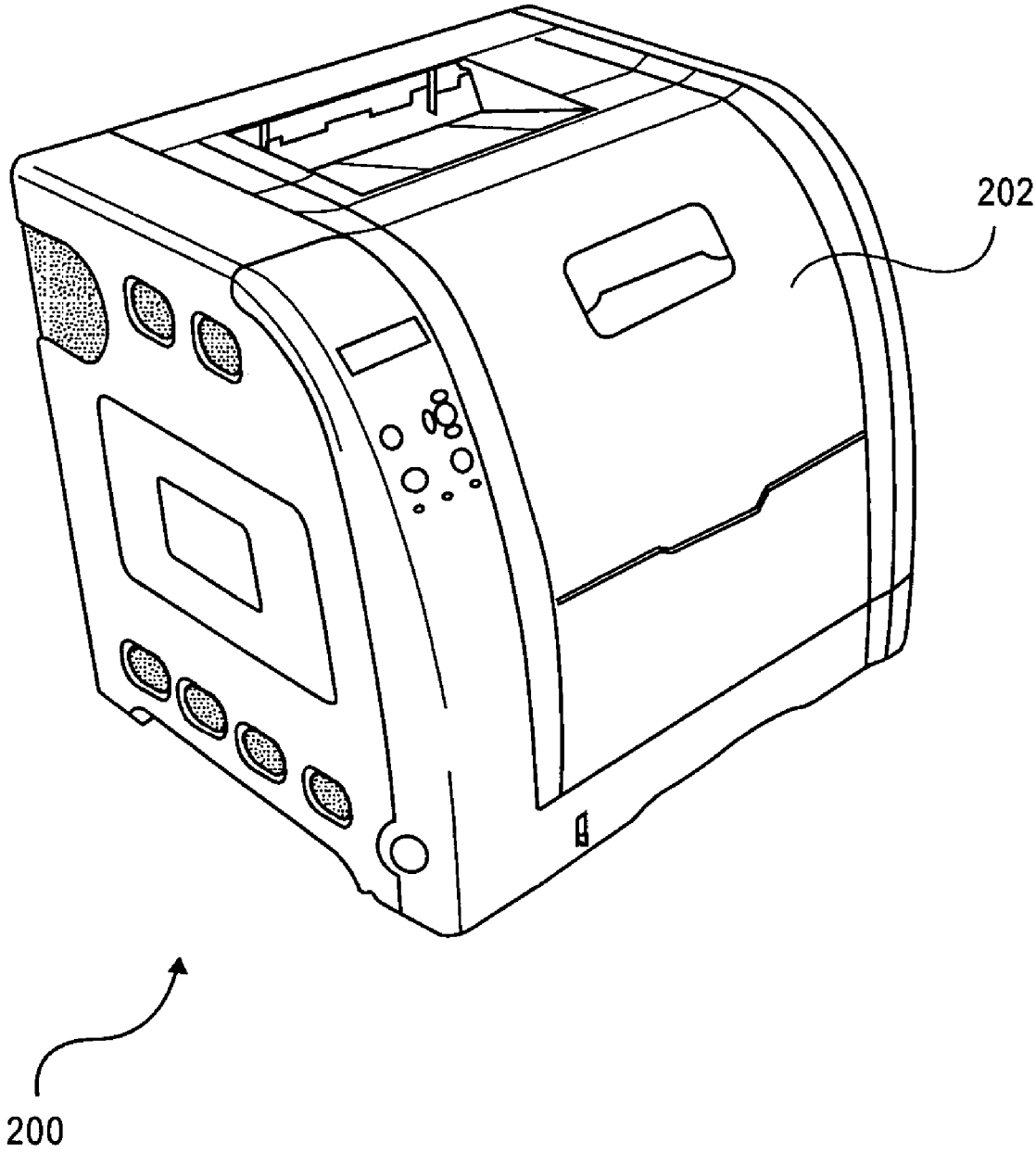
FIGS. 2A and 2B are diagrams of a laser printer having toner cartridges of differently colored toner to achieve full-color laser printing, according to an embodiment of the invention.
Figure 2B:
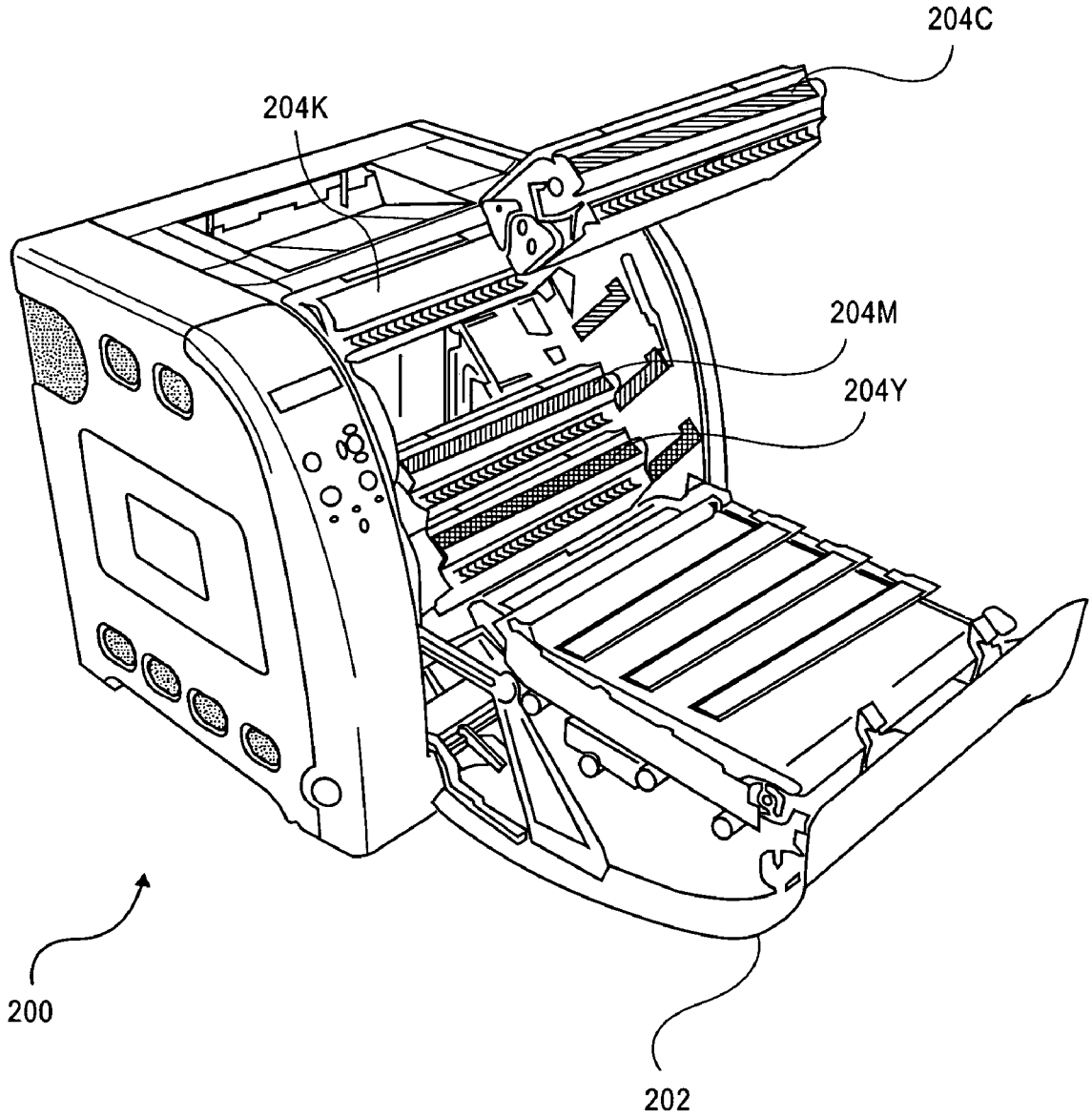

FIGS. 2A and 2B show an example of a multiple-color laser printer 200 that can be used to achieve full-color printing, according to an embodiment of the invention. The laser printer 200 is more generally a laser-printing device. In FIG. 2A, the cover 202 of the laser printer 200 is closed, whereas in FIG. 2B the cover 202 of the laser printer 200 is opened. As such, FIG. 2B shows that four different toner cartridges 204K, 204C, 204M, and 204Y can be inserted into the laser printer 200 to achieve full-color printing. The toner cartridge 204C is removed from the printer 200 in FIG. 2B, whereas the other cartridges 204K, 204M, and 204Y have been inserted into the printer 200 in FIG. 2B. The toner cartridges 204K, 204C, 204M, and 204Y correspond to black, cyan, magenta, and yellow toner, where combinations of these four colors can be used to achieve full-color printing.

Figure 3:
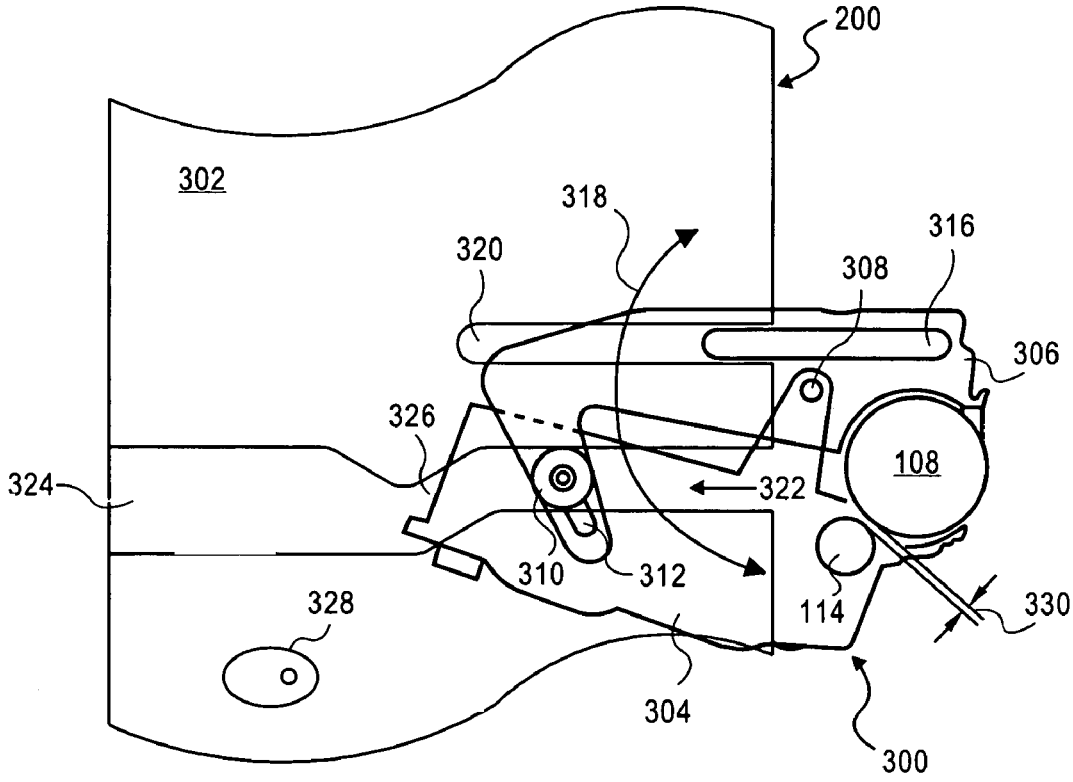
FIG. 3 is a diagram of a cross-sectional side view of a toner cartridge partially inserted into or partially removed from a printer, according to an embodiment of the invention.

FIG. 3 shows a cross-sectional side profile of a toner cartridge 300 being inserted into the printer 200, according to an embodiment of the invention. The toner cartridge 300 is representative of any of the toner cartridges 204K, 204C, 204M, and 204Y of FIG. 2. The toner cartridge 300 includes a lower portion 304 and an upper portion 306. The lower portion 304 may be considered the lower side supply of the cartridge 300, whereas the upper portion 306 may be considered the upper side waste of the cartridge 300. It is noted that the toner cartridge 300 may have other components in addition to those depicted in FIG. 3.

The upper portion 306 has a pin 308 coupled thereto such that a corresponding hole of the lower portion 304 mates with the pin 308 to couple the lower portion 304 to the upper portion 306. That is, the pin 308 is mounted within this hole. The lower portion 304 therefore is capable of pivoting relative to the upper portion 306 about the pin 308, which acts as the pivot point. Most generally, it can be stated that the lower portion 304 and the upper portion 306 are capable of moving relative to each other. Such movement is indicated in FIG. 3 by the bi-directional arrow 318. However, embodiments of the invention are not limited to the inclusion of the pin 308 so that the lower portion 304 and the upper portion 306 can move relative to one another.

The lower portion 304 of the toner cartridge 300 includes the developer roller 114, such that the roller 114 is situated at the lower portion 304, whereas the upper portion 306 includes the photoconductor drum 108, such that the drum 108 is situated at the upper portion 306. The lower portion 304 may further include other rollers, such as the charge roller 110 of FIG. 1, but such inclusion is not depicted in FIG. 3 for illustrative convenience. When the lower portion 304 rotates clockwise towards the upper portion 306, the roller 114 and the drum 108 separate, as indicated by the gap 330 therebetween. This is specifically depicted in FIG. 3. By comparison, when the lower portion 304 rotates counter-clockwise away from the upper portion 306, the roller 114 and the drum 108 come into contact with one another, which is not specifically depicted in FIG. 3. The portions 304 and 306 thus have a first position in which the roller 114 and the drum 108 contact one another, and a second position in which the roller 114 and the drum 108 are separated from one another.

The lower portion 304 of the toner cartridge 300 includes a guide 310, whereas the upper portion 306 includes a guide 316. The upper portion 306 further includes a slot 312 within which the guide 310 fits so that the lower portion 304 is able to move relative to the upper portion 306. When the toner cartridge 300 is inserted into the printer 200, the guide 316 of the upper portion 306 fits in a path or slot 320 of a sidewall 302 of the printer 200. Fitment of the guide 316 into the slot 320 maintains the upper portion 306 in place, whereas the lower portion 304 is capable of pivoting relative to the upper portion 306.

Furthermore, when the toner cartridge 300 is inserted into the printer 200, the guide 310 is inserted into an upper part 322 of a path of the sidewall 302 of the printer 200. The upper part 322 of the path is connected to a lower part 324 of the path via a transitional part 326 of the path that segues the upper part 322 to the lower part 324. The upper part 322 is parallel but non-collinear with the lower part 324. As the toner cartridge 300 is pushed into the printer 200, the lower portion 304 is forced to pivot counter-clockwise relative to the upper portion 306. This is because the guide 310 of the lower portion 304 moves from the upper part 322, through the transitional part 326, and to the lower part 324 of the path of the printer 200, whereas the upper portion 306 maintains its relative position due to its guide 316 being lodged in the slot 320. Counter-clockwise movement of the lower portion 304 relative to the upper portion 306 causes the roller 114 to contact the photoconductor drum 108.

It can be stated that the path defined by the parts 322, 324, and 326 thereof is receptive to the guide 310 of the toner cartridge 300, and causes the lower portion 304 of the cartridge 300 to move relative to the upper portion 306 of the cartridge 300 upon insertion of the cartridge 300 into the printer 200. The upper part 322 of the path makes initial contact with the guide 310 as the cartridge 300 is inserted into the printer 200, as compared to the other parts 324 and 326 of the path. The upper part 322 of the path further makes last contact with the guide 310 as the cartridge 300 is removed from the printer 200, as compared to the other parts 324 and 326 of the path. The path defined by the parts 322, 324, and 326, thus interacts with the path or slot 320 so that the lower portion 304 of the cartridge 300 moves relative to the upper portion 306 of the cartridge 300 upon removal or insertion of the cartridge 300 into the printer 200.

When the toner cartridge 300 is pulled from the printer 200, the lower portion 304 is conversely forced to pivot clockwise relative to the upper portion 306. This is because the guide 310 of the lower portion 304 moves from the lower part 324, through the transitional part 326, and to the upper part 322 of the path of the printer 200, whereas the upper portion 306 maintains its relative position due to its guide 316 being lodged in the slot 320. Clockwise movement of the lower portion 304 relative to the upper portion 306 causes the roller 114 to separate from the photoconductor drum 108. The printer 200 also includes a cam 328 in FIG. 3, the function of which is described later in the detailed description.

The toner cartridge 300 has a spring or other mechanism, not depicted in FIG. 3, to normally cause the lower portion 304 to move counter-clockwise relative to the upper portion 306, such that the roller 114 is in contact with the drum 108. That is, such a mechanism causes the lower portion 304 and the upper portion 306 to default to the position in which the roller 114 and the drum 108 are in contact with one another. Thus, the lower portion 304 defaults to counter-clockwise movement relative to the upper portion 306 when there is not a counteracting force to hold the lower portion 304 in place relative to the upper portion 306 so that the roller 114 and the drum 108 remain separated after the lower portion 304 has moved clockwise relative to the upper portion 306. The spring mechanism may be a coiled spring that is part of the pin 308, and which causes the lower portion 304 to normally pivot counter-clockwise relative to the upper portion 306. Such a coiled spring may be of the same general type as typically found in wristwatches, albeit on a larger scale. However, embodiments of the invention are not limited to a particular type of spring mechanism, such as such a coiled spring.

Figure 4:
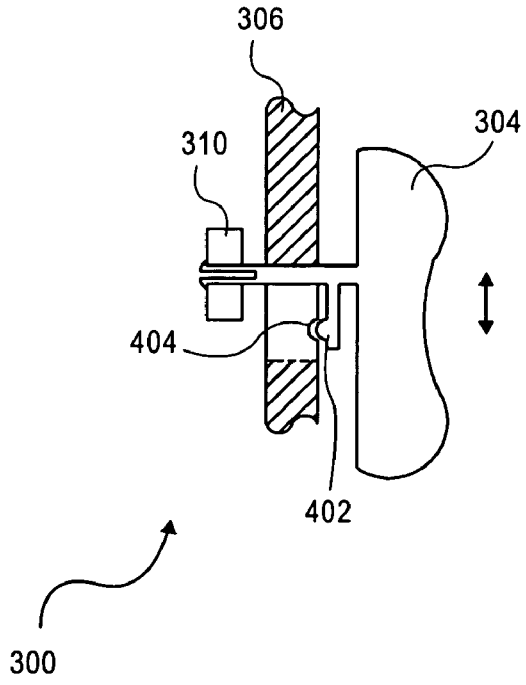
FIG. 4 is a diagram of a cross-sectional front view of a toner cartridge, depicting a locking mechanism thereof, according to an embodiment of the invention.

FIG. 4 shows a cross-sectional front view of a part of the toner cartridge 300 in which there is a locking mechanism to hold or maintain the lower portion 304 in place relative to the upper portion 306 after the lower portion 304 has moved relative to the upper portion 306, according to an embodiment of the invention. In particular, the lock mechanism includes a spring-loaded pin 402 coupled to the lower portion 304 and to the guide 310 of the lower portion 304, and which is capable of mating with a corresponding detent 404 within the upper portion 306. When the lower portion 304 moves clockwise relative to the upper portion 306 in FIG. 3, which corresponds to the lower portion 304 moving upwards relative to the upper portion 306 in FIG. 4, the pin 402 mates with the detent 404. As such, the lower portion 304 remains in position relative to the upper portion 306.

When the lower portion 304 is locked in position relative to the upper portion 306 via the pin 402 mating with the detent 404 in FIG. 4, the roller 114 is separated from the photoconductor drum 108 in FIG. 3. To unlock this locking mechanism, a sufficient force is needed to dislodge the spring-loaded pin 402 from the detent 404. Once the spring-loaded pin 402 has been dislodged from the detent 404, the spring or other mechanism that has been described again causes the lower portion 304 to move counter-clockwise relative to the upper portion 306 in FIG. 3, which corresponds to the lower portion 304 moving downwards relative to the upper portion 306 in FIG. 4. In this default position, the roller 114 is in contact with the drum 108 in FIG. 3. Thus, when the locking mechanism is not maintaining the lower portion 304 and the upper portion 306 in a position in which the roller 114 is separated from the drum 108, the spring or other mechanism reverts the lower portion 304 and the upper portion 306 into another position in which the roller 114 is in contact with the drum 108.

As has been described, in FIG. 3, inserting the toner cartridge 300 into the printer 200 results in the guide 310 of the lower portion 304 following the upper part 322 of the path defined by the sidewall 302, through the transitional part 326, and to the lower part 324 of this path. As the guide 310 moves from the upper part 322 to the lower part 324 in FIG. 3, the lowering of the guide 310 causes the pin 402 to be dislodged from the detent 404 in FIG. 4. Because the default position of the lower portion 304 relative to the upper portion 306 is when the lower portion 304 has pivoted counter-clockwise relative to the upper portion 306, dislodging of the pin 402 from the detent 404 results in the lower portion 304 pivoting counter-clockwise relative to the upper portion 306. As such, the roller 114 comes into contact with the photoconductor drum 108. Thus, insertion of the toner cartridge 300 into the printer 200 results in the guide 310 releasing the locking mechanism, such that the roller 114 contacts the drum 108.

Furthermore, as has been described, in FIG. 3, removing the toner cartridge 300 from the printer 200 results in the guide 310 moving from the lower part 324 of the path defined by the sidewall 302, through the transitional part 326, and to the upper part 322 of this path. As the guide 310 moves from the lower part 324 to the upper part 322 in FIG. 3, the raising of the guide 310 causes the pin 402 to again mate with the detent 404 in FIG. 4. The lower portion 304 thus is forced to remain in place upon its pivoting clockwise relative to the upper portion 306. As such, the roller 114 is again separated from the photoconductor drum 108.

The pin 402 and the detent 404 are one type of locking mechanism that can be employed, and other embodiments of the invention may use other types of locking mechanism. In general, the locking mechanism is such that during shipment of the toner cartridge 300, the forces typically encountered by the cartridge 300 during shipping are insufficient to cause the locking mechanism to unlock, such as the spring-loaded pin to dislodge from the detent 404. As such, when removed from the printer 200, such as during shipping, the cartridge 300 maintains separation of the roller 114 from the photoconductor drum 108, without any additional spacers or other parts.

Figure 5:
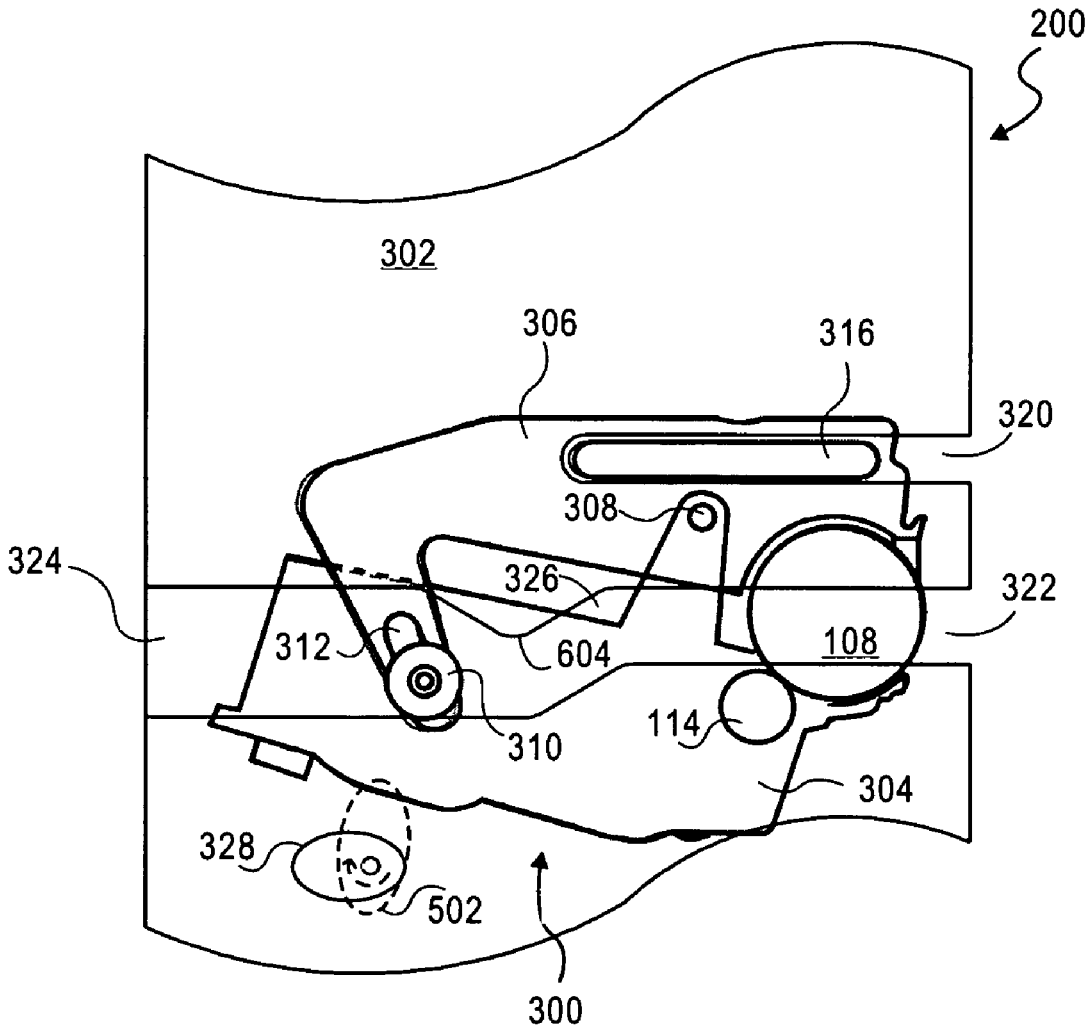
FIG. 5 is a diagram of a cross-sectional side view of a toner cartridge fully inserted into a printer in which a roller of the cartridge is in contact with a photoconductor drum of the cartridge, according to an embodiment of the invention.
Figure 6:
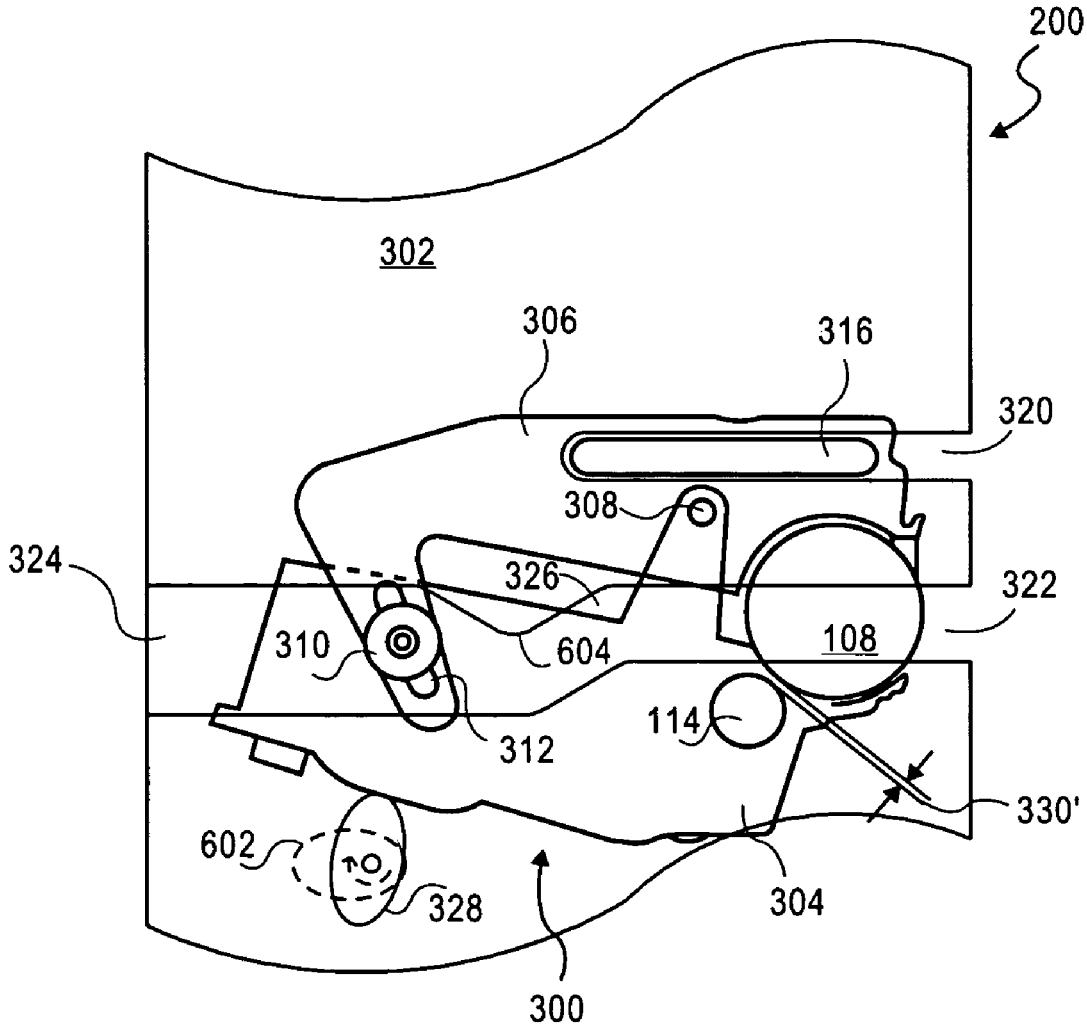
FIG. 6 is a diagram of a cross-sectional side view of a toner cartridge fully inserted into a printer in which a roller of the cartridge is separated from a photoconductor drum of the cartridge, according to an embodiment of the invention.

FIGS. 5 and 6 show how the cam 328 can be used to move the lower portion 304 relative to the upper portion 306 while the toner cartridge 300 is inserted into the printer 200, according to an embodiment of the invention. Like-numbered components among FIGS. 3, 5, and 6 operate identically within these figures, and where a given numbered component is not particularly described in relation to FIGS. 5 and 6, its operation is identical to that as has been described in relation to FIG. 3. The operation of such components is not duplicated in the description of FIGS. 5 and 6 to avoid descriptive redundancy.

As has been described in relation to FIGS. 3 and 4, as the toner cartridge 300 is inserted into the printer 200, the guide 310 moves from the upper part 322 of the path defined by the sidewall 302, through the transitional part 326, and to the lower part 324 of the path. This movement of the guide 310 causes the lower portion 304 to move counter-clockwise relative to the upper portion 306. As a result, the roller 114 is in contact with the photoconductor drum 108. This is the position in which the toner cartridge 300 is depicted in FIG. 5 upon complete insertion of the cartridge 300 into the printer 200.

In FIG. 5, the cam 328 is in a lowered position (as also denoted by reference number 602 in FIG. 6), whereas in FIG. 6, the cam 328 has been rotated or moved to an upright position (as also denoted by reference number 502 in FIG. 5). Movement of the cam 328 to the upright position in FIG. 6 causes the cam 328 to push or press upwards against the lower portion 304 of the toner cartridge 300. As a result, the lower portion 304 is forced to rotated clockwise relative to the upper portion 306 of the cartridge 300, causing the roller 114 to separate from the photoconductor drum 108.

However, movement of the cam 328 to its upright position in FIG. 6 is not sufficient to cause the locking mechanism to engage. Referring briefly back to FIG. 4, where the lower portion 304 has been moved lower than is indicated in FIG. 4 in relation to the upper portion 306, movement of the cam 328 as in FIG. 6 causes the lower portion 304 to move upwards, but not so far upwards as to cause the pin 402 to engage the detent 404. Thus, the separation between the roller 114 and the photoconductor drum 108 indicated by the gap 330' is less than the separation between the roller 114 and the drum 108 indicated by the gap 330 in FIG. 3.

Therefore, movement of the cam 328 from its upright position in FIG. 6 back to its lowered position in FIG. 5 results in the spring or other mechanism causing the lower portion 304 to rotate counter-clockwise relative to the upper portion 306, resulting in the roller 114 again contacting the photoconductor drum 108. That is, the cam 328 in its upright position in FIG. 6 acts as a counteracting force to the spring or other mechanism, to force the lower portion 304 to rotate clockwise relative to the upper portion 306 and stay in this position. Rotation or movement of the cam 328 to its lowered position in FIG. 5 removes this counteracting force to the spring or other mechanism. The spring or other mechanism thus forces the lower portion 304 to again rotate counter-clockwise relative to the upper portion 306. The lower portion 304 and the upper portion 306 thus revert or default to the position in which the roller 114 contacts the photoconductor drum 108.

In an embodiment of the invention in which there is no spring or other mechanism to force the lower portion 304 and the upper portion 306 to revert or default to the position in which the roller 114 contacts the drum 108, there may be an additional cam that is positioned over the lower portion 304 of the cartridge 300. Such an additional cam would be used to push the lower portion 304 back downwards so that it moves counter-clockwise relative to the upper portion 306, after the cam 328 has been rotated to its lowered position. That is, two cams may be employed in one embodiment of the invention to cause the lower portion 304 to move clockwise or counter-clockwise relative to the upper portion 306 as desired.

The cam 328 is more generally a mechanism movable between two positions. In one of the positions, it does not contact any portion of the cartridge 300, such as the lower portion 304, so that the roller 114 remains in contact with the photoconductor drum 108. In the other position, the mechanism contacts a portion of the cartridge 300, such as the lower portion 304, so that the roller 114 is separated from the photoconductor drum 108.

The lower part 324 of the path defined by the sidewall 302 of the printer 200 has a larger height than the upper part 322 and the transitional part 326 of the path have. This is so that the guide 310 is able to move upwards within the lower part 324 of the path when the cam 328 is in its upright position in FIG. 6 and is pushing against the lower portion 304 of the cartridge 300 such that the lower portion 304 rotates clockwise relative to the upper portion 306. During movement of the lower portion 304 resulting from the cam 328 pushing up against the lower portion 304 as depicted in FIG. 6, the upper portion 306 does not move because its guide 316 is lodged within the path or slot 320, and has a slot 312 to allow the guide 310 of the lower portion 304 to move therein.

There is a downwards-extending protrusion 604 on the top surface of the lower part 324 of the path defined by the sidewall 302 of the printer 200, as the lower part 324 segues to the transitional part 326 of the path. Upon removal of the toner cartridge 300 from the printer 200 while the lower portion 304 and the upper portion 306 are in the position depicted in FIG. 6, this protrusion 604 causes the guide 310 to move downward, thus causing the lower portion 304 to first rotate counter-clockwise relative to the upper portion 306. Once the cartridge 300 has been partially removed from the printer 200 such that the guide 310 is within the transitional part 326 of the path, the lower portion 304 again rotates clockwise relative to the upper portion 306. When the guide 310 has reached the upper part 322 of the path, the lower portion 304 has moved sufficiently clockwise relative to the upper portion 306 to engage the locking mechanism, such as the pin 402 engaging in the detent 404 in FIG. 4. As a result, the lower portion 304 and the upper portion 306 are locked in a position so that the roller 114 is not in contact with the photoconductor drum 108.

Figure 7:
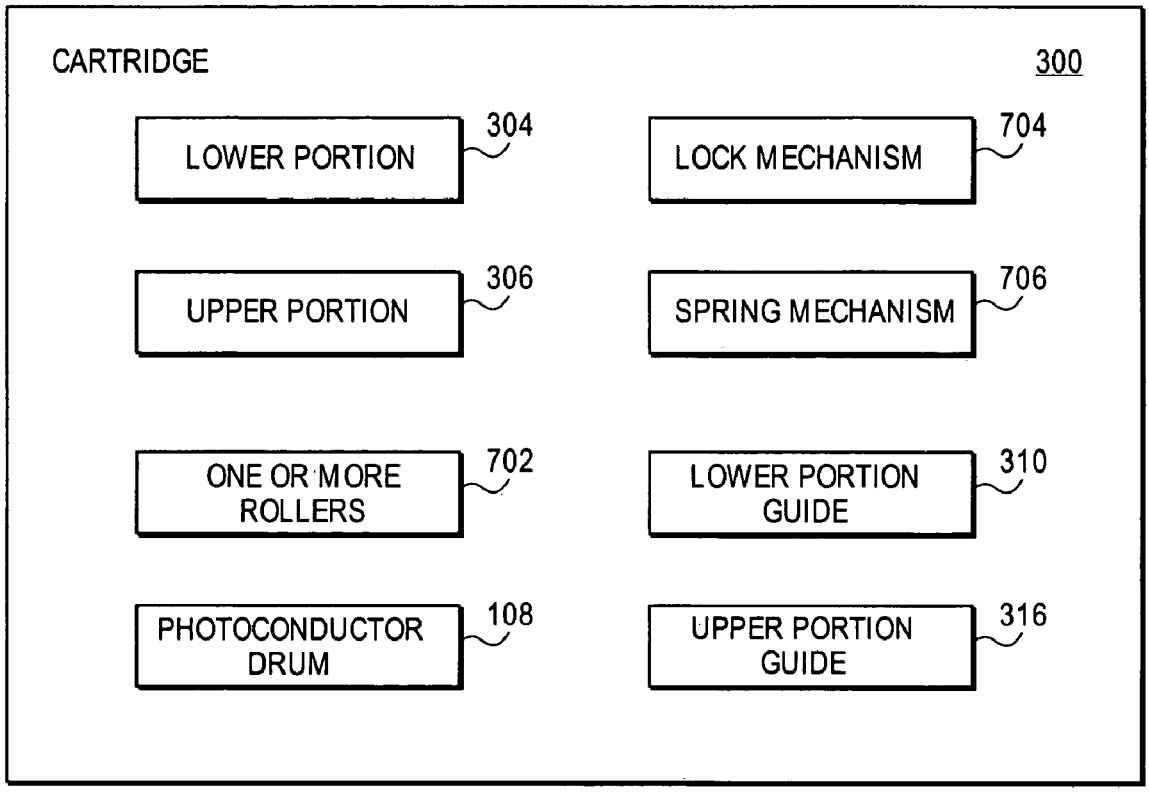
FIG. 7 is a block diagram of a toner cartridge, according to an embodiment of the invention.

FIG. 7 shows a block diagram of the toner cartridge 300, according to an embodiment of the invention, in relation to which a summary of the cartridge 300 is presented. The toner cartridge 300 in FIG. 7 includes the following components: the lower portion 304, the upper portion 306, one or more rollers 702, the photoconductor drum 108, a lock mechanism 704, a spring mechanism 706, the lower portion guide 310, and the upper portion guide 316. As can be appreciated by those of ordinary skill within the art, the cartridge 300 may have other components, in addition to and/or in lieu of those shown in FIG. 7. For instance, the cartridge 300 may have a supply of toner, within a toner hopper or toner sump.

The lower portion 304 and the upper portion 306 are coupled to one another and are capable of moving relative to each other, such as in the manner as has been described in relation to FIGS. 3, 5, and 6. The rollers 702 can include the developer roller 114, as well as the charge roller 110 and/or other rollers in one embodiment. The photoconductor drum 108 may also be referred to as an optical photoconductor, a photoconductor, a drum, an organic photoconductor, or by another term. The lower portion 304 and the upper portion 306 are capable of moving relative to one another to a first position in which the rollers 702 and the drum 108 contact one another, and to a second position in which the rollers 702 and the drum 108 are separated from one another.

The lock mechanism 704 maintains the lower portion 304 and the upper portion 306 in their second position, so that the rollers 702 and the drum 108 are separated from one another. Upon release of the lock mechanism 704, the spring mechanism 706 reverts the lower portion 304 and the upper portion 306 to their first position, so that the rollers 702 and the drum 108 are in contact with one another. The lock mechanism 704 may in one embodiment include a spring-loaded pin 402 and a detent 404, as has been described in relation to FIG. 4. The spring mechanism 706 may in one embodiment include a coiled spring that is part of or attached or coupled to a pin, of the same general type as typically found in wristwatches, albeit on a larger scale.

The lower portion guide 310, as has been described in relation to FIGS. 3, 5, and 6, releases the lock mechanism 704, upon insertion of the cartridge 300 into the laser printer 200, so that the lower portion 304 and the upper portion 306 enter their first position in which the rollers 702 and the drum 108 are in contact with one another. The lower portion guide 310, in other words, causes the lower portion 304 to move relative to the upper portion 306 to result in the rollers 702 and the drum 108 contacting one another. The lower portion guide 310 may be coupled to the lock mechanism 704, as has been described in relation to FIG. 4. The upper portion guide 316, as has been described in relation to FIGS. 3, 5, and 6, maintains the upper portion 306 in place, upon insertion of the cartridge 300 into the printer 200. Holding of the upper portion 306 in place by the upper portion guide 316 in this sense allows the lower portion guide 310 to cause the lower portion 304 to move relative to the upper portion 306, in one embodiment of the invention.

Figure 8:
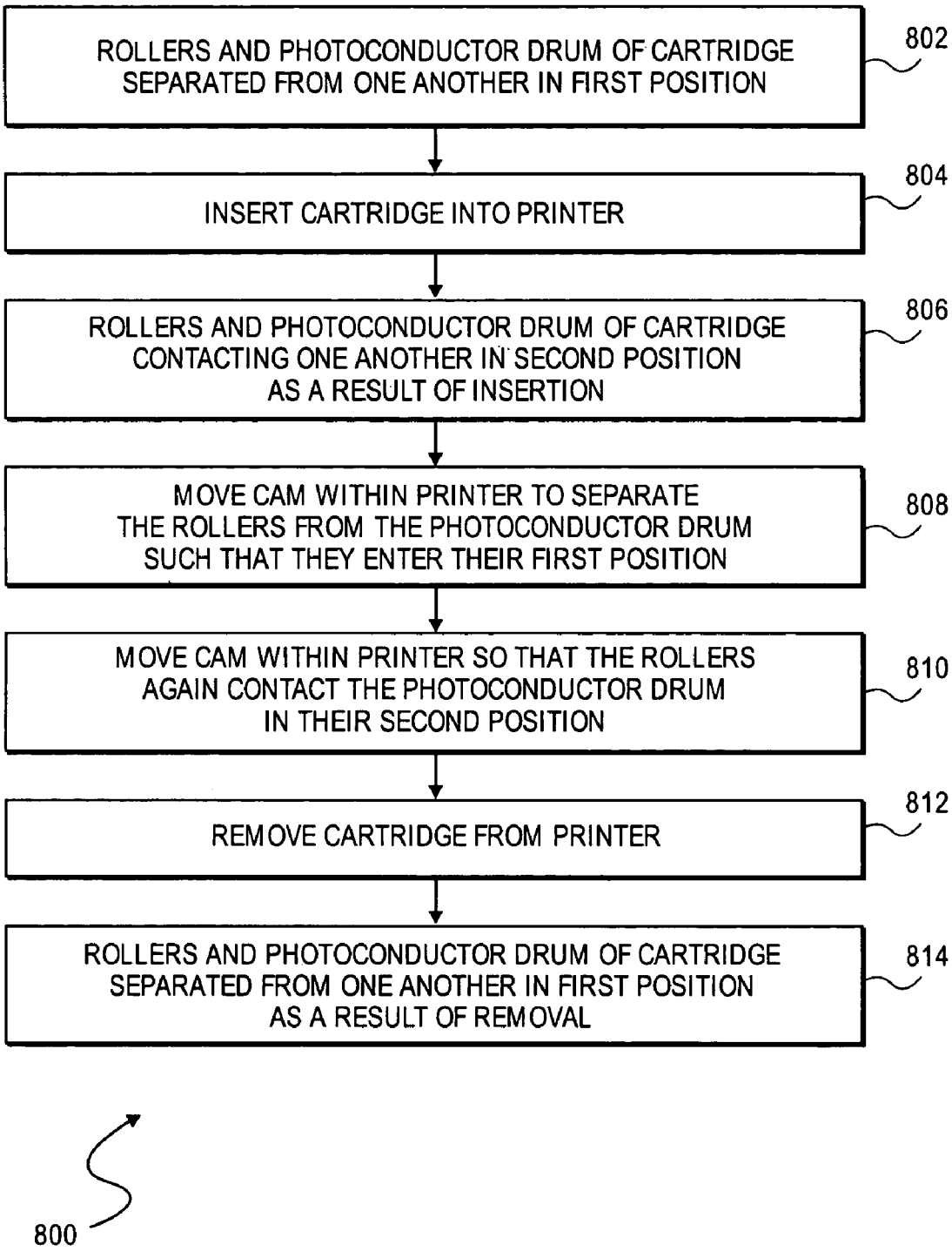
FIG. 8 is a flowchart of a method of use, according to an embodiment of the invention.

FIG. 8 shows a method 800 that may be performed in relation to the toner cartridge 300 of FIG. 7 that has been described, according to an embodiment of the invention. It is noted that while the method 800 is substantially described in relation to multiple rollers, it is applicable to just one roller, such as just the charge roller or just the developer roller, as well. Initially the toner cartridge 300, prior to insertion into the laser printer 200, has its rollers 702 and its photoconductor drum 108 separated from one another in a first position (802). (It is noted that the first position of the rollers 702 and the drum 108 corresponds to the second position of the lower portion 304 and the upper portion 306 as has been described.) The toner cartridge 300 is then inserted into the laser printer 200 (804). As has been described in relation to FIGS. 3, 5, and 6, such insertion results in or causes the rollers 702 and the drum 108 to contact one another and thus enter a second position (806). (It is noted that the second position of the rollers 702 and the drum 108 corresponds to the first position of the lower portion 304 and the upper portion 306 as has been described.)

While the toner cartridge 300 is inserted into the laser printer 200, a cam 328 or other mechanism within the printer 200 may be moved or rotated to again separate the rollers 702 from the photoconductor drum 108 such that they reenter their first position (808). Similarly, while the toner cartridge 300 is inserted into the printer 200, the cam 328 or other mechanism may subsequently be moved or rotated to cause the rollers 702 to again contact the drum 108, in their second position (810). The toner cartridge 300 is ultimately removed from the laser printer 200 (812). As has been described in relation to FIGS. 3, 5, and 6, such removal results in or causes the rollers 702 and the drum 108 to be separated, in their first position (814).

It is noted that, although specific embodiments have been illustrated and described herein, it will be appreciated by those of ordinary skill in the art that any arrangement calculated to achieve the same purpose may be substituted for the specific embodiments shown. For example, embodiments of the invention have been largely described in relation to a printing device that is a laser printer. However, other embodiments of the invention may be implemented in relation to other printers that employ a photoconductor and one or more rollers. In addition, whereas embodiments of the invention have been largely described in relation to a toner cartridge for a laser printer, other embodiments may be implemented in relation to other types of cartridges for other types of printers.

Furthermore, embodiments of the invention have largely been depicted where there is one roller, a developer roller, being in contact with or separated from a photoconductor drum. In other embodiments, however, there may be more than one roller, such as both a developer roller and a charge roller, being in contact with or separated from the photoconductor drum. Furthermore, these rollers may be positioned so that one of them is in contact with the drum while the other is not. For instance, the charge roller may be caused to contact the drum upon insertion of the cartridge into the printer, such that it remains in contact with the drum at all times while the cartridge is inside the printer. Conversely, the developer roller may either be separated from or in contact with the drum while in the printer, by appropriate usage of a cam or other mechanism, as has been described.

This application is thus intended to cover any adaptations or variations of the disclosed embodiments of the present invention. For instance, whereas embodiments of the invention have been described in relation to rollers being separated from the photoconductor, such that there are two states: contact of the rollers with the photoconductor in a first position and separation of the rollers from the photoconductor in a second position, in other embodiments of the invention, there may be more than two such states. For example, in a state "A" two rollers may be in contact with the photoconductor, in a state "B" one roller may be in contact with the photoconductor and the other roller may not be in contact with the photoconductor, and in a state "C" both rollers may not be in contact with the photoconductor. The claims that follow read on this embodiment, because "one or more rollers" can be interpreted in one instance to mean only one of these rollers, such that it is in contact with the photoconductor in a first state "A" and not in contact in a second state "B" (or "C"). The claims can then be interpreted so that "one or more rollers" means that the other roller is in contact with the photoconductor in a first state "A" and not in contact in a second state "C". That is, "one or more rollers" can be interpreted to mean just one roller, even where there is more than one roller in the cartridge.

It is noted that embodiments of the invention may have contact or no contact between the rollers and the photoconductor in different situations while the cartridge is in the printing device. For instance, during printing at least one of the rollers (or just one of the rollers) may not be in contact with the rollers, in so-called "gap" printing, whereas in another embodiment, at least one of the rollers may be in contact with the photoconductor, in so-called "contact" printing. A control logic within the printing device may thus cause the rollers to individually contact or not contact the photoconductor as needed, based on whether printing is occurring or not, for instance.

Finally, it is noted that separating the rollers from the photoconductor upon removal of the cartridge from a printing device is desirable, because it allows a softer mail to be considered for the rollers, especially the developer roller. A softer developer roller allows less wear and tear on the toner, due to smaller stresses, and this increases developer life. It is manifestly intended that this invention be limited only by the claims and equivalents thereof.

We claim:

1. A cartridge for a printing device comprising:

a first portion and a second portion coupled to one another and capable of moving relative to each other;

one or more rollers situated at the first portion;

a photoconductor situated at the second portion, the rollers in contact with the photoconductor in a first position of the first and the second portions; and, a lock mechanism to secure the first and the second portions in a second position in which the rollers are separated from the photoconductor, wherein the lock mechanism is adapted to release the first and the second portions from the second position during insertion of the cartridge into the printing device, and to secure the first and the second portions in the second position during removal of the cartridge from the printing device, and wherein one or more of:

the lock mechanism comprises a spring-loaded pin attached to the first portion and capable of mating with a corresponding detent of the second portion so that the first and the second portions are maintained in the second position;

the cartridge further comprises a spring mechanism to revert the first and the second portions to the first position upon the lock mechanism being released, such that the first position is a position to which the first and the second portions default but for maintenance thereof in the second position by the lock mechanism.

2. The cartridge of claim 1, wherein the first and the second portions are coupled to one another at a pivot point about which the first and the second portions are capable of pivoting relative to one another.

3. The cartridge of claim 2, further comprising a pin coupled to the second portion and acting as the pivot point, the first portion having a hole into which the pin is mounted such that the first portion is capable of pivoting relative to the second portion about the pin.

4. The cartridge of claim 1, further comprising a guide coupled to the lock mechanism, the guide adapted to release the lock mechanism upon insertion of the cartridge in the printing device, such that the first and the second portions enter the first position and the rollers contact the photoconductor.

5. The cartridge of claim 1, wherein the first portion is a lower portion of the cartridge and the second portion is an upper portion of the cartridge.

6. The cartridge of claim 1, wherein the rollers comprise one or more of a developer roller and a charge roller.

7. The cartridge of claim 1, wherein the photoconductor is one or more of an optical photoconductor, an organic photoconductor, and a photoconductor drum.

8. The cartridge of claim 1, wherein the cartridge is a toner cartridge and the printing device is a laser-printing device.

9. A cartridge for a printing device comprising:

a first portion and a second portion coupled to one another and capable of moving relative to each other;

one or more rollers situated at the first portion;

a photoconductor situated at the second portion, the rollers in contact with the photoconductor in a first position of the first and the second portions;

a lock mechanism to maintain the first and the second portions in a second position in which the rollers are separated from the photoconductor;

a spring mechanism to revert the first and the second portions to the first position upon the lock mechanism being released; and, a guide coupled to the lock mechanism and adapted to release the lock mechanism during insertion of the cartridge in the printing device such that the first and the second portions enter the first position, and to secure the lock mechanism during removal of the cartridge from the printing device such that the first and the second portions enter the second position.

10. The cartridge of claim 9, further comprising another guide, coupled to the second portion, to maintain the second portion in place during insertion of the cartridge into the printing device.

11. A cartridge for a printing device comprising:

a first portion and a second portion coupled to one another and capable of moving relative to each other;

one or more rollers situated at the first portion;

a photoconductor situated at the second portion, the rollers in contact with the photoconductor in a first position of the first and the second portions; and, means for locking the first and the second portions in a second position in which the rollers are separated from the photoconductor, wherein the means is adapted to release the first and the second portions from the second position during insertion of the cartridge into the printing device, and to secure the first and the second portions to the second position during removal of the cartridge from the printing device, and wherein one or more of:

the means comprises a spring-loaded pin attached to the first portion and capable of mating with a corresponding detent of the second portion so that the first and the second portions are maintained in the second position;

the cartridge further comprises a spring mechanism to revert the first and the second portions to the first position upon the means being released, such that the first position is a position to which the first and the second portions default but for maintenance thereof in the second position by the means.

12. The cartridge of claim 11, further comprising means for reverting the first and the second portions to the first position upon the means for locking being released.

13. The cartridge of claim 11, further comprising means for releasing the means for locking upon insertion of the cartridge in the printing device such that the first and the second portions enter the first position.

14. A printing device comprising:

a path receptive to a guide of a cartridge having one or more rollers and a photoconductor, the path having a first part in which exit of the guide therethrough causes the rollers to lockably separate from the photoconductor, and a second part in which entry of the guide therein causes the rollers to unlockably contact the photoconductor; and, a mechanism movable between a first position in which the mechanism does not contact the cartridge such that the rollers remain in contact with the photoconductor and a second position in which the mechanism presses against the cartridge such that the rollers separate from the photoconductor, wherein the first and the second parts of the path are parallel but non-collinear, the path having a third part segueing the first and the second parts.

15. The printing device of claim 14, wherein the first and the second parts of the path are adapted so that the guide makes initial contact with the first part upon insertion of the cartridge into the printing device and last contact with the first part upon removal of the cartridge from the printing device.

16. The printing device of claim 14, further comprising a second path receptive to a second guide of the cartridge, the guide of the cartridge coupled to a first portion of the cartridge and the second guide coupled to a second portion of the cartridge, the second path adapted to maintaining in place the second portion of the cartridge as the first portion moves relative to the second portion, the path adapted to causing the first portion to move relative to the second portion.

17. The printing device of claim 14, wherein the cartridge has a first portion capable of moving relative to a second portion of the cartridge, the mechanism in the first position not contacting the first portion of the cartridge, and the mechanism in the second position pushing the first portion of the cartridge such that the first portion moves relative to the second portion.

18. The printing device of claim 14, wherein the mechanism is a cam.

19. The printing device of claim 14, wherein the printing device is a laser-printing device and the cartridge is a toner cartridge.

20. A printing device comprising:

a plurality of paths receptive to corresponding guides attached to different portions of a cartridge insertable into the printing device, the paths adapted to receiving the corresponding guides to cause the different portions of the cartridge to move relative to one other so that one or more rollers attached to one portion of the cartridge contact a photoconductor of another portion of the cartridge; and, a mechanism movable between a first position and a second position, the mechanism in the first position not contacting any portion of the cartridge such that the rollers remain in contact with the photoconductor, and the mechanism in the second position pushing one portion of the cartridge to cause the different portions of the cartridge to move relative to one another so that the rollers are separated from the photoconductor, wherein during exit of the cartridge from the printing device the paths are adapted to cause the rollers to lockably separate from the photoconductor and during insertion of the cartridge into the printing device the paths are adapted to cause the rollers to unlockably contact the photoconductor.

21. The printing device of claim 20, wherein the paths are adapted so that removal of the cartridge from the printing device results in the different portions of the cartridge moving relative to one another so that the rollers are separated from the photoconductor.

22. A method comprising:

inserting a cartridge into a printing device, the cartridge having one or more rollers and a photoconductor that are separated from one another in a first position prior to insertion of the cartridge into the printing device, and a lock mechanism to maintain the rollers and the photoconductor in the first position prior to insertion of the cartridge into the printing device; and, contacting of at least one of the rollers with the photoconductor in a second position, resulting from insertion of the cartridge into the printing device, wherein the lock mechanism is adapted to release the rollers and the photoconductor from the first position during insertion of the cartridge into the printing device, and to secure the rollers and the photoconductor in the first position during removal of via a spring-loaded pin of the lock mechanism mating with a corresponding indent of the lock mechanism.

23. The method of claim 22, further comprising:

removing the cartridge from the printing device;

separating of at least one of the rollers from the photoconductor such that the rollers and the photoconductor enter the first position, resulting from removal of the cartridge from the printing device.

24. The method of claim 22, further comprising moving a mechanism within the printing device to separate at least one of the rollers from the photoconductor such that the rollers and the photoconductor enter the first position.

25. The method of claim 24, farther comprising moving the mechanism within the printing device so that at least one of the rollers contact the photoconductor and the rollers and the photoconductor enter the second position.

* * * * *

UNITED STATES PATENT AND TRADEMARK OFFICE

CERTIFICATE OF CORRECTION

PATENT NO. : 7,221,888 B2
APPLICATION NO. : 11/113541
DATED : May 22, 2007
INVENTOR(S) : Scott K. Hymas et al.

It is certified that error appears in the above-identified patent and that said Letters Patent is hereby corrected as shown below:

In column 11, line 51, in Claim 6, delete "of" and insert -- of: --, therefor.

In column 11, line 53, in Claim 7, delete "of" and insert -- of: --, therefor.

In column 14, line 27, in Claim 22, insert -- the cartridge from the printing device -- before "via".

In column 14, line 41, in Claim 25, delete "farther" and insert -- further --, therefor.

Signed and Sealed this

Nineteenth Day of August, 2008

JON W. DUDAS
*Director of the United States Patent and Trademark Office*